US006266962B1

(12) United States Patent
Ghoshal

(10) Patent No.: US 6,266,962 B1
(45) Date of Patent: Jul. 31, 2001

(54) HIGHLY RELIABLE THERMOELECTRIC COOLING APPARATUS AND METHOD

(75) Inventor: Uttam Shyamalindu Ghoshal, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/414,334

(22) Filed: Oct. 7, 1999

(51) Int. Cl.[7] ..... F25B 21/02

(52) U.S. Cl. ..... 62/3.7; 62/3.3

(58) Field of Search ..... 62/3.7, 3.3, 3.61, 62/3.62

(56) References Cited

U.S. PATENT DOCUMENTS

| | | | | |
|---|---|---|---|---|
| 3,650,117 | * | 3/1972 | Robinson et al. | 62/3 |
| 3,879,229 | | 4/1975 | Gilbert | 136/208 |
| 4,095,998 | | 6/1978 | Hanson | 136/208 |
| 4,453,114 | * | 6/1984 | Nordlund | 62/3 X |
| 4,673,863 | | 6/1987 | Swarbrick | 322/2 R |
| 4,833,889 | * | 5/1989 | Harwell et al. | 62/3.2 |
| 4,848,090 | * | 7/1989 | Peters | 62/3.3 |
| 5,130,276 | | 7/1992 | Adams et al. | 437/225 |
| 5,279,128 | | 1/1994 | Tomatsu et al. | 62/3.4 |
| 5,361,587 | | 11/1994 | Hoffman | 62/3.2 |
| 5,385,022 | | 1/1995 | Kornblit | 62/3.2 |
| 5,448,891 | | 9/1995 | Nakagiri et al. | 62/3.1 |
| 5,465,578 | | 11/1995 | Barben et al. | 62/3.2 |
| 5,605,048 | * | 2/1997 | Kozlov | 62/3.7 |
| 5,650,904 | * | 7/1997 | Gilley et al. | 62/3.7 X |
| 5,687,573 | * | 11/1997 | Shih | 62/3.7 X |
| 5,690,849 | * | 11/1997 | DeVilbiss et al. | 62/3.7 X |
| 5,720,171 | * | 2/1998 | Osterhoff et al. | 62/3.6 |
| 5,881,560 | * | 3/1999 | Bielinski | 62/3.7 X |

OTHER PUBLICATIONS

WO 94/28364; A Peltier Device; Dec. 8, 1994 (Publication Date):Michael Graeme et al.

EP 0 667 498 A1; Method of Cooling a Unit of a Cascade Thermopile; Aug. 16, 1995; Kozlov et al.

05172424; Heat Pump Device; Jul. 9, 1993 (Publication Date); Nakagiri Yasushi.

05039966; Heat Pump Device; Feb. 19, 1993 (Publication Date); Nakagiri Yasushi.

* cited by examiner

*Primary Examiner*—Corrine McDermott
*Assistant Examiner*—Chen-Wen Jiang
(74) *Attorney, Agent, or Firm*—Casimer K. Salys; Duke W. Yee

(57) ABSTRACT

Apparatus, method, and signal for sub-ambient cooling using thermoelectric dynamics in conjunction with configurations and activation schemes to maximize the mean time between failure (MTBF) of thermoelectric coolers. In one form, a signal is provided which periodically alters the state of the Peltier devices from an active state to a passive state. During the active state the Peltier device provides maximum cooling and during the passive state the Peltier device minimizes thermal leakage while reducing cooling. Preferable implementations provide multiple signals to thermoelectric arrays such that, for a predetermined time, a first set of the arrays are in the active state while a second set of the arrays are in the passive state to thereby minimize failures and maximize the MTBF of the thermoelectric arrays.

46 Claims, 6 Drawing Sheets

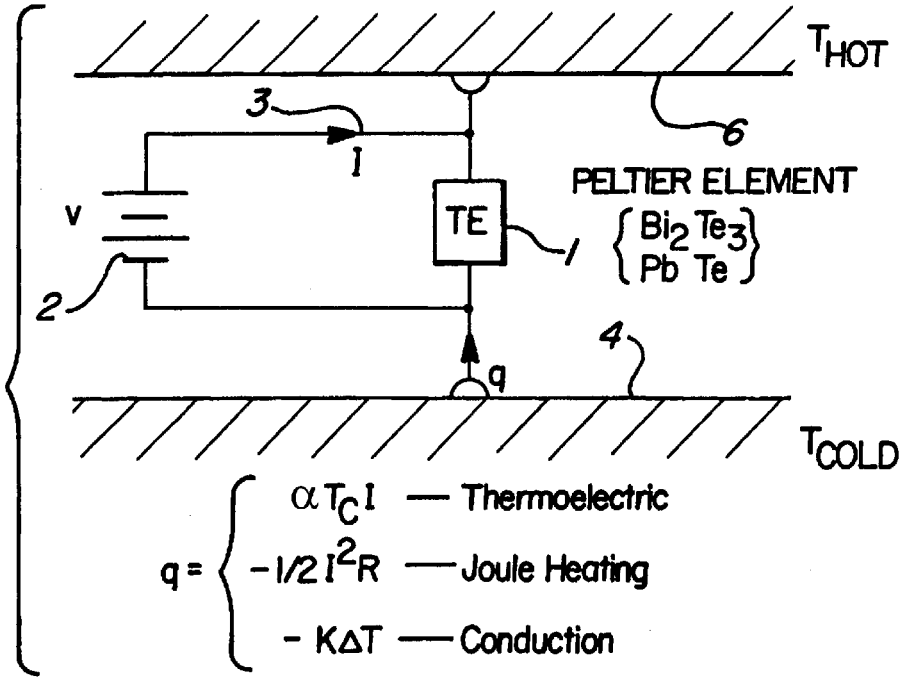
FIG - 1
PRIOR ART
FIG - 2
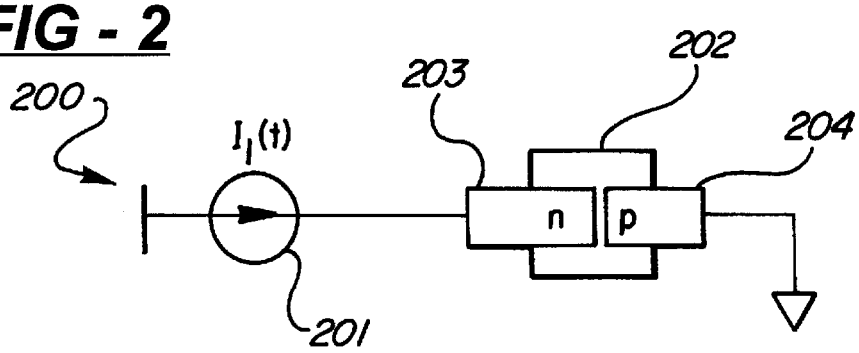

HIGHLY RELIABLE THERMOELECTRIC COOLING APPARATUS AND METHOD

FIELD OF THE INVENTION

The present invention generally relates to thermoelectric cooling. More particularly, the invention is directed to apparatuses and methods for attaining high relative reliable thermoelectric cooling without compromising performance or efficiency through novel thermoelectric element configurations and activation schemes.

BACKGROUND OF THE INVENTION

Sub-ambient cooling is conventionally accomplished through gas/liquid vapor phase compression based refrigeration cycles using Freon type refrigerants to implement the heat transfers. Such refrigeration systems are used extensively for cooling human residences, foods, and vehicles. Sub-ambient cooling is also often used with major electronic systems such as mainframe server and workstation computers. Though vapor compression cooling can be very efficient, it does require significant moving hardware, including at a minimum, a compressor, a condenser, an evaporator, and related coolant transfer plumbing. As a result of the complexity, associated high cost, and lower reliability, vapor compression cooling has not found material acceptance in small cooling applications, for example personal computers.

The fact that CMOS logic can operate materially faster as the temperature decreases has been well known for at least ten years. For example, if CMOS logic devices are operated at −50° C., the performance is improved by 50 percent over room ambient temperature operation. Liquid nitrogen operating temperatures, in the range of −196° C., have shown 200 percent performance improvements. Similar benefits have shown to accrue for integrated circuit wiring, where metal wiring resistances decrease by a factor of 2 for integrated circuits operated at −50° C. in comparison to room ambient operation. This improvement rivals the recent technological breakthrough of using copper wiring in integrated circuits to reduce interconnect resistance and thereby effectively increase the operating frequencies attainable. Thus, sub-ambient operation of integrated circuit logic devices, such as field effect transistors, as well as the interconnect wiring can materially improve the integrated circuit performance, leaving the question of how to accomplish such cooling in the confines of an ever decreasing size and materially shrinking cost environment.

Thermoelectric cooling is one alternative that has found some usage given the compact size of the prevalently used Peltier devices. A Peltier device is fabricated from semiconductor material such as bismuth telluride or lead telluride. Though new materials are now being evaluated in various universities, they have yet to reach fruition. The commonly used Peltier materials exhibit very high electrical conductivity and relatively low thermal conductivity, in contrast to normal metals which have both high electrical and thermal conductivity. In operation the Peltier devices transport electrons from a cold sink, at temperature $T_{cold}$, to a hot sink, at temperature $T_{hot}$, in response to an electric field formed across the Peltier device.

FIG. 1 schematically depicts a conventional Peltier type thermoelectric element (TE) 1 with DC power supply 2 creating the electric field across TE 1 while at a load current 3. The desired heat transfer is from cold sink 4, at temperature $T_{cold}$, to hot sink 6, at temperature $T_{hot}$. As indicated in the equation of FIG. 1, the net heat energy transported is composed of three elements, the first representing the Peltier effect (thermoelectric) contribution, the second defining negative Joule heating effects, and the third defining negative thermal conduction effects. The thermoelectric component is composed of the Seebeck coefficient, the temperature of operation ($T_{cold}$) and the current being applied. The Joule heating component reflects that roughly half the Joule heating goes to the cold sink and remainder to the hot sink. Lastly, the negative component attributable to thermal conduction represents the heat flow through the Peltier device, as defined by the thermal conductivity of the Peltier device, from the hot sink to the cold sink. See equation (1).

$$q=aT_{cold}I\text{-}FR/2-K\Delta T \quad (1)$$

While the reliability of thermoelectric cooling is better than mechanical-based cooling systems, there are a variety of long term degradation mechanisms which reduce the reliability of thermoelectric cooling below acceptable standards for thermoelectric elements operating at relatively high wattage. For example, single stage thermoelectric elements can only attain mean-time-between failure (MTBF) ratings of greater than 250,000 hours if $T_{hot}$ is kept below 90° C. One of the primary degradation mechanisms leading to relatively low reliability thermoelectric cooling is the degradation of the junction between the semiconductor materials used to form the thermoelectric element and the materials used for the hot sink.

Typically, thermoelectric cooling systems connect several Peltier devices electrically in series and thermally in parallel making the thermoelectric cooling system vulnerable to a single Peltier device failing. The Peltier devices are typically created using copper tabs to create the electrical junctions to the semiconductor materials used to form thermoelectric element and thermal junctions to the thermal sinks used on the hot and cold end of the thermoelectric cooler. Degradation of the thermoelectric cooler occurs at the hot end of the cooler due to the solder used to create the junction between the copper tabs and the semiconductor materials. Bismuth-Tin alloy solders, containing small amounts of various metals such as tin, selenium, tellurium, antimony and nickel, are used to create the junctions between the copper tabs and the semiconductor materials. During operation, high levels of current flow through the thermoelectric cooler leading to a degradation mechanism at the hot end caused by electromigration. As high levels of current flow, the metals from the solder migrate to the semiconductor material creating metal spikes that penetrate the surface of the semiconductor material causing swelling and cracking of the solder joints leading to failure of the thermoelectric cooler.

Several configurations have been deployed to address the reliability of Peltier devices. One configuration, described in U.S. Pat. No. 5,650,904, uses a redundancy scheme that allows a failed Peltier device to be bypassed to avoid failures caused by Peltier devices electrically connected in series. The redundancy scheme suffers from performance loss when the redundant Peltier device and circuitry are activated. Though this design may increase the MTBF of the thermoelectric cooler, the overall cost and size of thermoelectric cooling, its efficiency and performance suffer due to the additional Peltier and bypass devices.

Thus, there are a number of very fundamental constraints on current thermoelectric coolers that have created a need for providing thermoelectric coolers having an increased reliability with relatively greater mean time between failures without compromising performance or efficiency.

SUMMARY OF THE INVENTION

The present invention overcomes the reliability constraints of thermoelectric element cooling through the application of a signal to periodically alter the state of the thermoelectric element, from an active state to a passive state, to thereby maximize the mean time between failures of the thermoelectric element without compromising its performance efficiency.

In one form, the invention relates to a thermoelectric cooling apparatus comprising a source, a thermoelectric cooler coupled to the source, the thermoelectric cooler having an operating state, wherein the source is configured to provide a signal to the thermoelectric cooler to periodically alter the operating state of the thermoelectric cooler in response to the signal.

In another form, the invention relates to a thermoelectric cooling apparatus comprising a source, a first thermoelectric cooler coupled to the source, the first thermoelectric cooler having a first state, a second thermoelectric cooler coupled to the source, the second thermoelectric cooler having a second state. The source is configured to provide a first signal to the first thermoelectric cooler to periodically alter the first state of the first thermoelectric cooler in response to the first signal, and the source is further configured to provide a second signal to the second thermoelectric cooler to periodically alter the second state of the second thermoelectric cooler in response to the second signal.

In a still further form, the invention relates to a method of operating a thermoelectric cooling apparatus having a source, a thermoelectric cooler coupled to the source, the thermoelectric cooler has an operating state, comprising the steps of providing a signal to the thermoelectric cooler, and periodically altering the operating -state of the thermoelectric cooler in response to the signal.

In a still further form, the invention relates to a method of operating a thermoelectric cooling apparatus having a source, a first thermoelectric cooler coupled to the source, wherein the thermoelectric cooler has a first state, a second thermoelectric cooler coupled to the source, wherein the second thermoelectric cooler has a second state. The method comprising the steps of providing a first signal to the first thermoelectric cooler, periodically altering the first state of the first thermoelectric cooler in response to the signal, providing a second signal to the second thermoelectric cooler, and periodically altering the state of the second thermoelectric cooler in response to the second signal.

In yet another form, the invention relates to a signal, propagating in a propagation medium for operating a thermoelectric cooler, for periodically altering the thermoelectric cooler from a first state to a second state.

In still another form, the invention relates to a thermoelectric cooling apparatus providing a thermoelectric cooler and a monitoring circuit associated with the thermoelectric cooler for monitoring operating characteristics of the thermoelectric cooler.

In a particularized form of the invention, a thermoelectric cooling apparatus is provided having a source and first and second thermoelectric cooler coupled to the source. The source provides a first signal to the first thermoelectric cooler to periodically alter its state in response to the first signal and a second signal to the second thermoelectric cooler to periodically alter its state in response to the second signal. The second signal is phase shifted relative to the first signal such that, for a predetermined period of time, the first thermoelectric cooler is in an active state while the second thermoelectric cooler is in a passive state. The active state maximizes cooling created by the thermoelectric cooler during operation while the passive state reduces cooling and thermal conduction losses associated with operating thermoelectric in a passive state. In this manner, failures caused by constant activation of the thermoelectric cooler can be minimized.

These and other features of the invention will be more clearly understood and appreciated upon considering the detailed embodiments described hereinafter.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

FIG. 1 schematically depicts a conventional statically operable Peltier device cooling system.

FIG. 2 is a simplified schematic of a thermoelectric cooling apparatus according to a preferred embodiment of the present invention.

DETAILED DESCRIPTION OF A PREFERRED EMBODIMENT OF THE INVENTION

Figure 3:
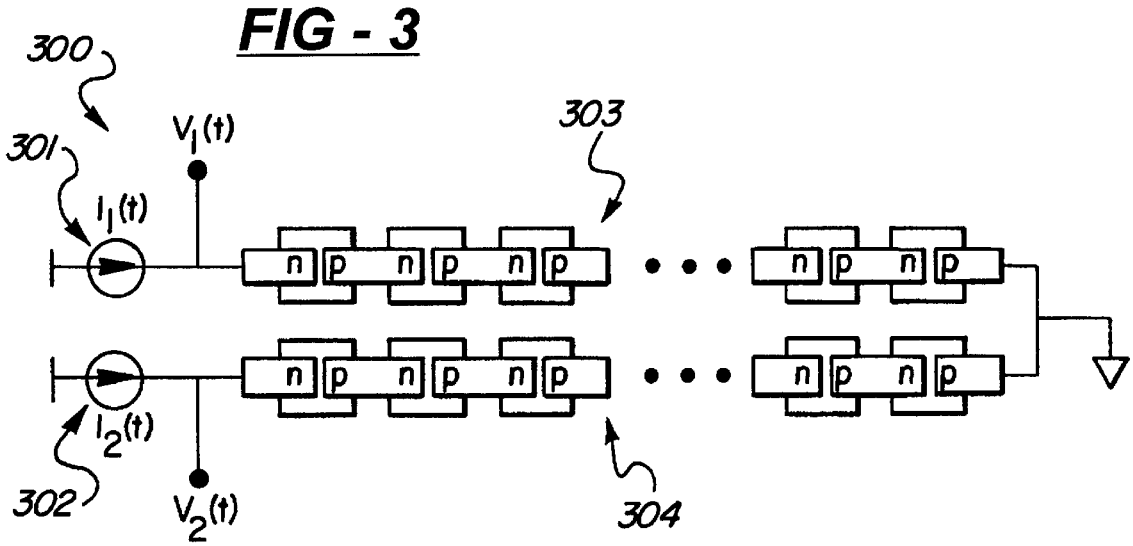
FIG. 3 schematically illustrates a thermoelectric cooling apparatus according to one embodiment of the present invention.

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The conceptual groundwork for the present invention involves minimizing failures in a thermoelectric cooler by avoiding constant activation of the thermoelectric cooler without compromising the overall cooling capacity and efficiency of the thermoelectric cooler or the thermoelectric cooling apparatus including the thermoelectric cooler. The objective is to utilize a source to provide a signal to a thermoelectric cooler to periodically alter the state of the thermoelectric cooler from an active state, wherein the cooling created by the thermoelectric cooler is maximized while in operation, to a passive state, wherein the cooling is minimized while in operation. In this manner an acceptable temperature differential is created by the thermoelectric cooler without constant activation of the thermoelectric cooler thereby increasing the MTBF.

Referring to FIG. 2, a simplified schematic of a thermoelectric cooling apparatus according to a preferred embodiment of the present invention. Thermoelectric cooling apparatus 200 includes source 201 for providing a signal $I_1(t)$ to thermoelectric cooler 202. Source 201 may be any electrical source however, in a preferred embodiment of the invention source 201 is a current source providing signal $\mathbf{1}_1(t)$. Thermoelectric cooler 202 includes n-type material 203 and p-type material 204 configured to produce a temperature differential. In one embodiment of the present invention, n-type material 203 and p-type material 204 are coupled to hot and cold sinks (not shown) utilizing copper tabs. The copper tabs are soldered to n-type material 203 and p-type material 204 creating electrical and thermal junctions. Source 201 provides signal $\mathbf{1}_1(t)$ to thermoelectric cooler 202 to alter the operating state of thermoelectric cooler 202 from an active state to a passive state.

In a preferred embodiment of the present invention, cooling provided by thermoelectric cooling apparatus 200 is created by operating thermoelectric cooler 202 in an active state. Additionally, as source 201 provides signal $I_1(t)$ to thermoelectric cooler 202 to alter the operating state of thermoelectric cooler 202 from an active state to a passive state, the cooling provided by thermoelectric cooler 202 is minimized by providing signal $I_1(t)$ at a level to counteract any thermal conduction loss associated with thermoelectric cooler 202. For example, if thermoelectric cooler 202 was placed in an "off" state with no current being conducted through thermoelectric cooler 202, an undesirable temperature differential would be produced across thermoelectric cooler 202 due to thermal leakage. However, by $I_1(t)$ providing a signal to alter the state of thermoelectric cooler 202 from an active state to a passive state, constant activation of thermoelectric cooler 202 is avoided and thermal leakage of thermoelectric cooler 202 is minimized.

In another embodiment of the present invention, the active state can correspond to any cooling level and associated current level attainable by thermoelectric cooler 202. Thus, the active state is not limited to a single temperature differential. For example, the signal provided to thermoelectric cooler 202 can alter the state of the cooler to any percentage (i.e. 20, 30, 100, etc.) of the maximum temperature differential attainable by thermoelectric cooler 202. For instance, thermoelectric cooler 202 can be configured to provide a maximum temperature differential of 40° C. but, an object to be cooled may only require a temperature differential of 10° C. Therefore, the signal provided to thermoelectric cooler 202 would have active and passive states for creating a 10° C. temperature differential.

In the preferred embodiment of the invention, source 201 provides a periodic signal $I_1$ (t) to alter the operating state between a passive state and an active state, whereby in a passive state thermal leakage and cooling are minimized during operation and in an active state cooling is maximized during operation. Through periodically altering the state of thermoelectric cooler 202, constant activation of thermoelectric cooler 202 is avoided while maintaining an acceptable temperature differential and increasing the MTBF.

Referring now to FIG. 3, a schematic illustration of a thermoelectric cooling apparatus according to one embodiment of the present invention is shown. Thermoelectric cooling apparatus 300 includes source 301 coupled to a first thermoelectric array 303 for providing an input signal $I_1(t)$ to thermoelectric array 303. Thermoelectric cooling apparatus 300 also includes source 302 coupled to a second thermoelectric array 304 for providing an input signal $I_2(t)$ to thermoelectric array 304. In the embodiment of FIG. 3, thermoelectric arrays are utilized having a plurality of Peltier devices configured to cool to an object (not shown). Additionally, source 301 and source 302 are illustrated as being separate sources but it can be appreciated by those skilled in the art that a single source can be utilized to provide a plurality of output signals with varying periods and associated phase shifts.

In a preferred embodiment of the present invention, thermoelectric cooling apparatus 300 is configured such that source 301 provides a signal $I_1(t)$ to thermoelectric array 303 to periodically alter the state of thermoelectric array 303 from an active state, wherein the cooling created by thermoelectric array 303 is maximized, to a passive state wherein thermal leakage and cooling created by thermoelectric array 303 is minimized while in operation.

Additionally, source 302 is configured to provide a signal $I_2(t)$ to thermoelectric array 304 to periodically alter the state of thermoelectric array 304 from a passive state, wherein thermal leakage and cooling are minimized during operation, to an active state wherein the cooling created by thermoelectric array 304 is maximized. In a preferred embodiment, signals $I_1(t)$ and $I_2(t)$ have a phase shift relative to one another such that for a predetermined period of time, thermoelectric array 303 is in a passive state and thermoelectric array 304 is an active state. Additionally, for a predetermined period of time thermoelectric array 303 is in an active state and thermoelectric array 304 is in a passive state. Therefore, by periodically altering the states of thermoelectric arrays 303 and 304, an acceptable temperature differential is created by thermoelectric cooling apparatus 300 without constant activation of each thermoelectric array thereby increasing the MTBF.

Figure 4:
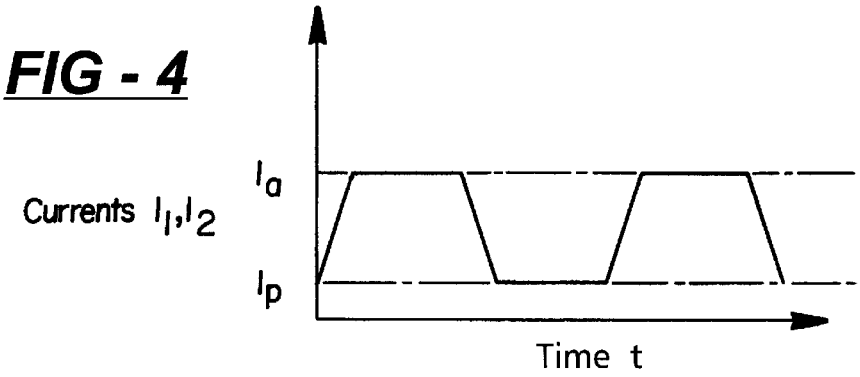
FIG. 4 illustrates a signal according to the present invention.

Referring now to FIG. 4, an illustration of a signal according to the present invention is shown. The signal is a periodic signal for altering the state of a thermoelectric cooler from the active state to the passive state. In a preferred embodiment the signal is provided by a current source. Equations (2)–(5) mathematically describe the signal as applied to a thermoelectric cooling apparatus such as thermoelectric cooling apparatus 300. In the active state the signal has a current $\mathbf{1}_a$ and in the passive state the signal has a current $I_p$ wherein $$I_a = \frac{\alpha \Delta T}{R\left(\sqrt{1 + Z\overline{T}} - 1\right)} \tag{2}$$

$I_a$ = Active current signal state $R$ = Combined resistance of thermoelectric arrays $\Delta T$ = Temperature differential across the thermoelectric cooling apparatus $Z$ = Thermoelectric figure of merit $\alpha$ = Seebeck coefficient $\overline{T}$ = Average temperature across the thermoelements and wherein $$I_p = \left(\frac{\alpha T_c}{R}\right)\left(1 - \sqrt{1 - \frac{\Delta T}{\Delta T_{max}}}\right) \quad (3)$$

$I_p$ = Passive current signal state $R$ = Combined resistance of thermoelectric arrays $\Delta T$ = Change in temperture $\alpha$ = Seebeck coefficient $T_c$ = Temperature of the cold end of the thermoelectric cooling apparatus $\Delta T_{max}$ = maximum temperature differential across the thermoelectric cooling apparatus and wherein $$R = \left(\frac{V_1 - V_2}{I_1 - I_2}\right) \quad (4)$$

$R$ = Combined resistance of thermoelectric arrays $V_1$ = Voltage across the first thermoelectric junction array $V_2$ = Voltage across the second thermoelectric junction array $I_1$ = Current through the first thermoelectric junction array $I_2$ = Current through the second thermoelectric junction array and wherein $$\Delta T = \frac{(I_1 V_2 - I_2 V_1)}{\alpha(I_1 - I_2)} \quad (5)$$

$\Delta T$ = Temperature differential across the thermoelectric cooling apparatus $V_1$ = Voltage across the first thermoelectric junction array $V_2$ = Voltage across the second thermoelectric junction array $I_1$ = Current through the first thermoelectric junction array $I_2$ = Current through the second thermoelectric junction array $\alpha$ = Seebeck coefficient Equations (2)–(5) are described in terms of the thermoelectric cooling apparatus of FIG. 3 wherein the voltage level VI is the voltage across thermoelectric array 303 in FIG. 3 and $I_1$ is the current associated with that voltage level. Likewise, $V_2$ is the voltage across thermoelectric array 304 in FIG. 3 and $I_2$ represents the current associated with that voltage level. The signal illustrated in FIG. 4 is utilized by thermoelectric cooling apparatus 300 for periodically altering the states of thermoelectric arrays 303 and 304. In one instance source 301 provides a signal $\mathbf{1}_1(t)$ to thermoelectric array 303 and source 302 provides a signal $\mathbf{1}_2(t)$ to thermoelectric array 304. In a preferred embodiment $I_1(t)$ and $\mathbf{1}_2(t)$ are phase shifted relative to one another such that, for a predetermined time, thermoelectric array 303 is in an active state created by signal $I_1(t)$ having current $I_a$ while thermoelectric array 304 is in a passive state created by signal $\mathbf{1}_2(t)$ having current $I_P$. The active state, having current level $I_a$, is defined by equation (2) having a maximum coefficient of performance (COP) or efficiency for a given ΔT and the passive state, having current level $I_p$, is defined by equation (3) where the cooling capacity through the thermoelectric array in a passive state is zero, thus counteracting any thermal conduction losses associated with the thermoelectric array being in a passive state. Therefore, each signal provided to thermoelectric arrays 303 and 304 as determined by equations (2)–(5) above ensure that an acceptable temperature differential is maintained without constant activation of thermoelectric arrays 303 and 304 and thermal losses associated with thermoelectric elements 303 and 304 being in a passive state are minimized.

Figure 5:
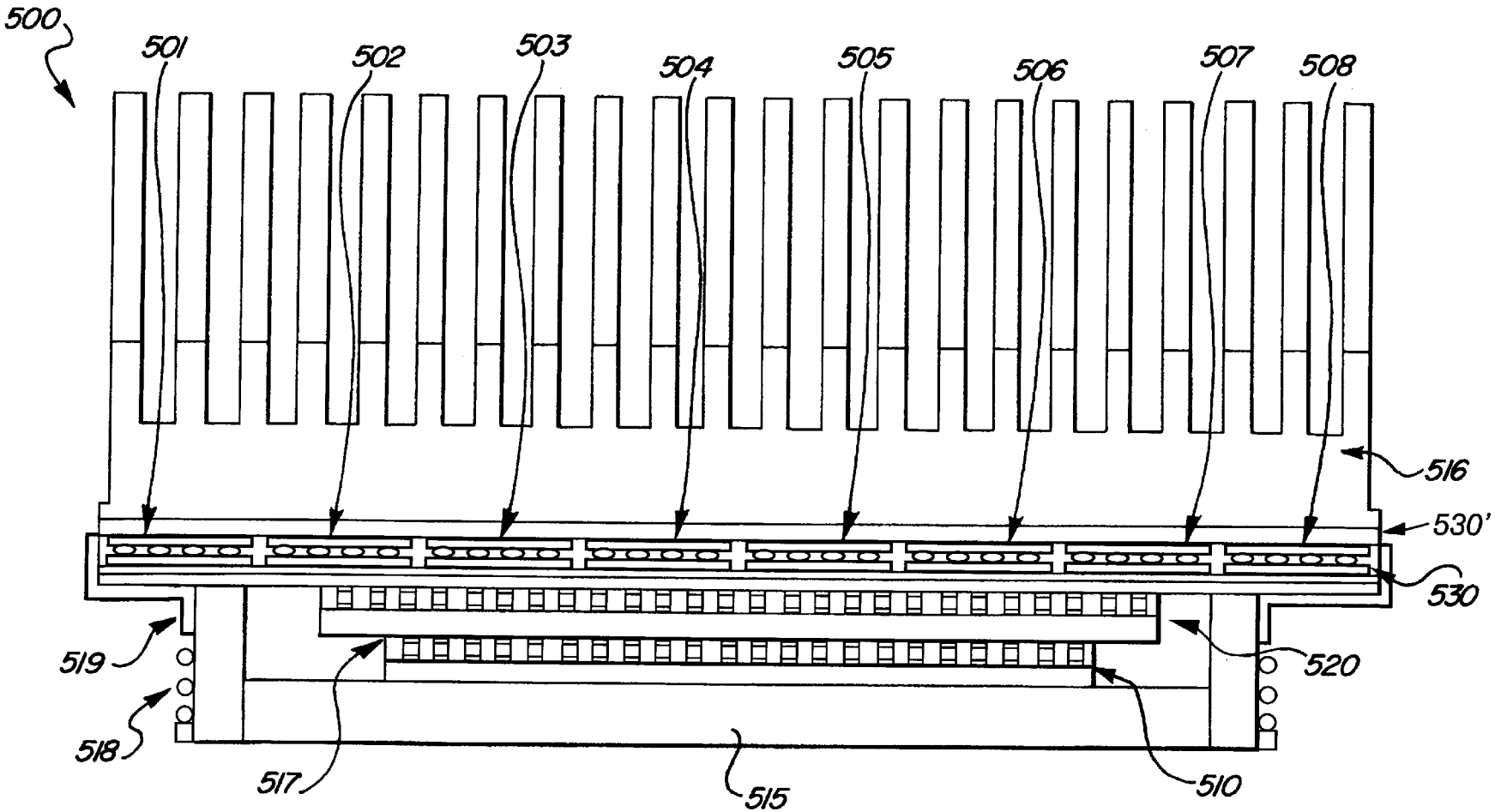
FIG. 5 schematically depicts a thermoelectric cooling apparatus according to another embodiment of the present invention.

Referring now to FIG. 5 a schematic illustration of a thermoelectric cooling apparatus according to another embodiment of the present invention. Thermoelectric cooling apparatus 500 is configured to be multi-staged having a first stage 510 configured to provide a first temperature differential wherein first stage 510 is thermally coupled to object 515 to be cooled. Second stage 520 is thermally coupled to first stage 510 and configured to provide a second temperature differential. Thermoelectric cooling apparatus 500 further includes third stage 530 thermally coupled to second stage 520 and heat sink 516 and configured to provide a third temperature differential. Third stage 530 includes thermoelectric arrays 501–508 508 and is configured to provide a third temperature differential through periodically altering the states of thermoelectric arrays 501–508 from active states, wherein the cooling created by thermoelectric arrays 501–508 is maximized while in operation, to passive states wherein thermal losses and cooling are minimized during operation. In a preferred embodiment of the present invention, first and second stages 510 and 520 are continuously activated providing a temperature differential while some of thermoelectric arrays 501–508 within third stage 530 are in an active state and some of thermoelectric arrays 501–508 within third stage 530 are in a passive state. Any combination of thermoelectric arrays can be in an active state or in a passive state to provide any desirable cooling amount by third stage 530. In this manner, an acceptable temperature differential is created by third stage 530 without constant activation of thermoelectric arrays 501–508 thereby increasing the MTBF of thermoelectric cooling apparatus 500.

For example, thermoelectric cooling apparatus 500 provides a signal to periodically alter the states of thermoelectric arrays 501, 503,505, and 507 from active states to passive states wherein thermoelectric arrays 501, 503, 505, 507 having active states provide maximum cooling during operation and thermoelectric arrays 501, 503, 505, 507 having passive states minimize the thermal losses and cooling during operation. Additionally, thermoelectric cooling apparatus 500 provides a signal to periodically alter the states of thermoelectric arrays 502,504,506, and 508 from passive states, wherein the thermal losses and cooling created by thermoelectric arrays 502, 504, 506, 508 are minimized during operation, to active states wherein cooling created by thermoelectric arrays 502, 504, 506, 508 is maximized while in operation. Through periodically altering the states of thermoelectric arrays 501–508 within the third stage, an acceptable temperature differential is created by avoiding constant activation of thermoelectric arrays 501–508 thereby increasing the MTBF and reducing thermal losses associated with operating thermoelectric elements 501–508 in a passive state.

In the preferred embodiment, thermoelectric cooling apparatus 500 further includes hermetic sealing 517 for ensuring minimal exposure to external elements and defrost resistors 518 and hygrometer 519 for providing defrost and humidity control as required. Preferably, thermoelectric cooling apparatus 500 utilizes a monitoring circuit for monitoring cooling efficiency, defrost control, and degradation of thermoelectric arrays. In one embodiment of the invention, thermoelectric arrays 501–508 are configured to be field replaceable allowing replacement of detected faulty thermoelectric arrays.

Figure 6:
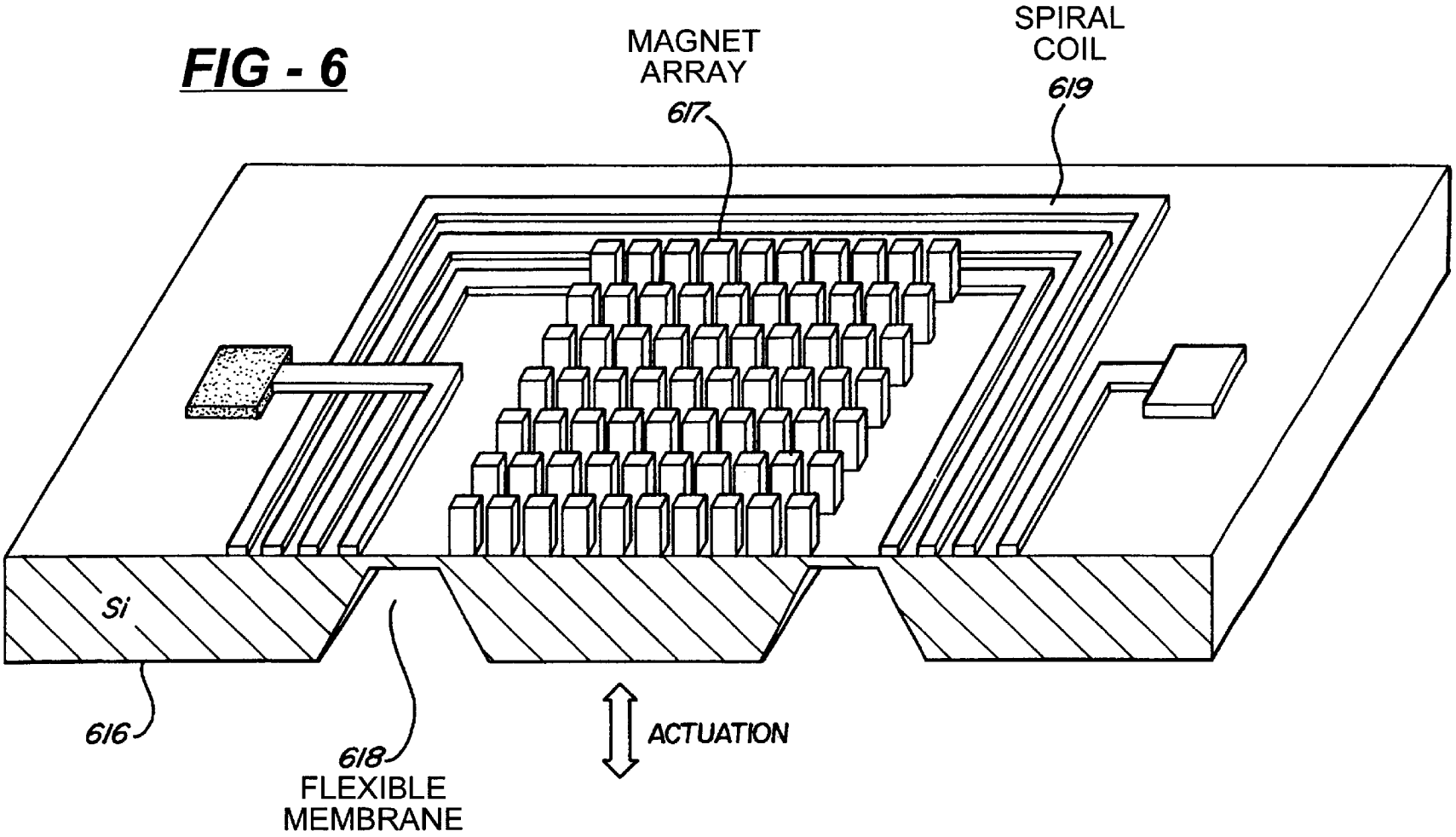
FIG. 6 schematically depicts a microelectromechanical systems (MEMS) device.

FIG. 6 schematically illustrates the structure of a representative microelectromechanical systems (MEMS) switch of the type particularly suited to the present invention. For a further discussion and description of MEMS and the uses and applications of MEMS see pending U.S. patent application Ser. No. 08/988,621 and U.S. Pat. No. 5,867,990 issued Feb. 9, 1999 both of common inventor and assignee as the present application and which are hereby incorporated by reference. Since MEMS technology is still in its infancy, the switch depicted in FIG. 6 merely illustrates one of many potential switch configurations suitable to provide a selective electrical and thermal coupling between the thermoelectric cooler and the sinks. The switch shown in FIG. 6 is fabricated using conventional integrated circuit techniques so as to form on a surface of silicon chip 616 an array of nickel magnets 617 amenable to a slight displacement by movement at thin flexible membranes 618. Introduction of an electrical current into spiral coil 619 produces a force adequate to translate the magnetic array in a direction perpendicular to the plane of the silicon chip. The MEMS switch in FIG. 6 should have a relatively low thermal conductivity when opened yet a relatively high electrical and thermal conductivity when closed by actuation. Since the MEMS device in FIG. 6 is to accomplish both electrical and thermal switching, numerous evolutionary refinements are expected to accentuate the dual functions.

The MEMS type thermal switch described with reference to the illustrations in FIG. 6 is merely one of many potential switch configurations. For example, it is fully contemplated that electrostatic forces generated in capacitive switch structures could be used to accomplish similar objectives. The underlying goal for all the switches is to maximize the thermal conductivity extremes for switch positions, such that when the switch is closed the thermal path between the thermoelectric element and the sink has a maximum thermal conductance while for the open switch the thermal conductance is the minimum attainable, while minimizing electrical conduction Joule heating and maximizing the extremes of the electrical switch states.

Figure 7:
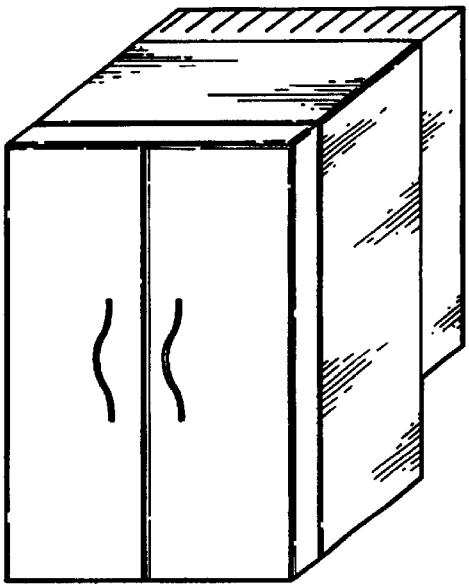
FIG. 7 schematically depicts the extended use of the invention to a food refrigeration system.

FIG. 7 schematically illustrates the use of the present invention in an extended array form to efficiently and cleanly operate a food refrigerator. The high efficiency of an apparatus utilizing mechanical and thermoelectric cooling system is characterizing the present invention facilitates the migration of mixed cooling from highly selective and limited applications, such as mainframe computer system cooling, to major appliances in substantially every home.

Figure 8:
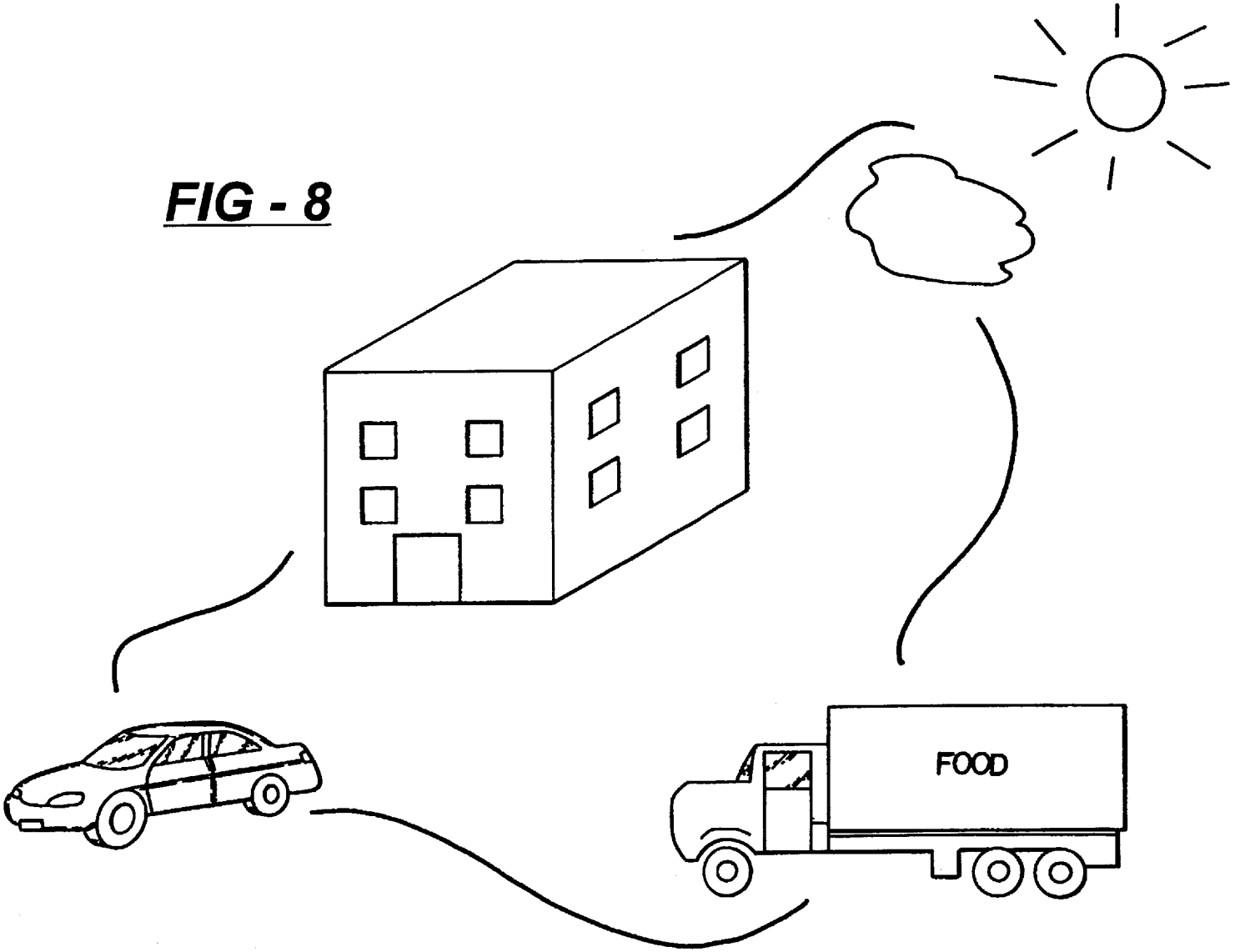
FIG. 8 schematically depicts potential applications and benefits of the invention as applied to various human residences and transportation media.

Still further applications are schematically depicted in FIG. 8, as the concepts underlying the present invention are further refined and extended in size to encompass major heat transfer applications encompassing residential and office cooling, food transportation systems, and personal vehicle cooling.

Figure 9:
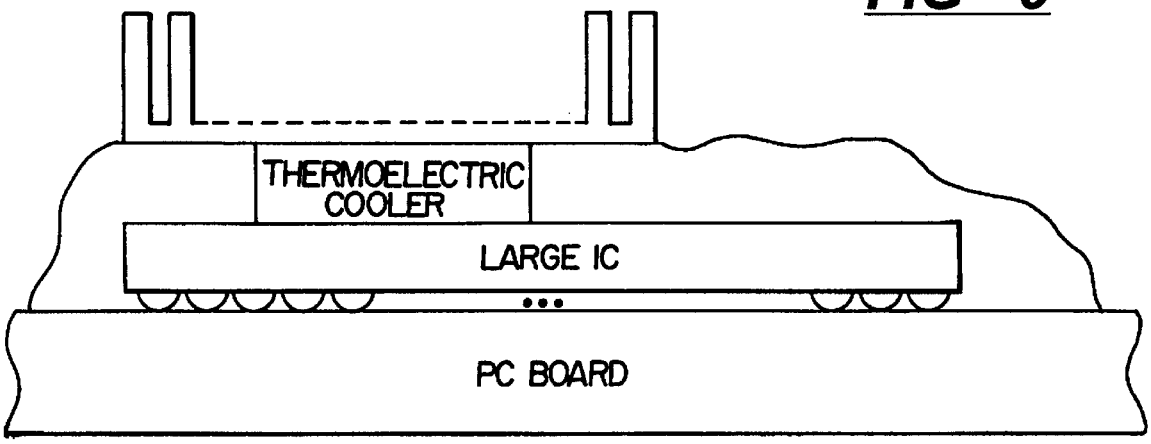
FIG. 9 schematically depicts the application of a small thermoelectric cooler to locally cool a selected part of an integrated circuit chip.

FIG. 9 schematically illustrates an application somewhat at the other end of the spectrum, where a micro size cooling apparatus is selectively bonded to parts of an integrated circuit chip for purposes of selective region cooling to control integrated circuit parameters. Such localized or spot cooling applications are particularly useful for voltage controlled oscillators, phase detectors, mixers, low noise amplifiers, lasers, photodiodes, and various material type optoelectric circuits.

The present invention has very broad applicability in part because it is not constrained to specific thermoelectric materials, cooling systems or electronic configurations. The invention utilizes the thermal dynamics of thermoelectric coolers to isolate heat transfer characteristics and attain higher cooling efficiency, while maximizing the mean time between failures of the thermoelectric coolers.

It will be understood by those skilled in the art that the embodiments set forth hereinbefore are merely exemplary of the numerous arrangements for which the invention may be practiced, and as such may be replaced by equivalents without departing from the invention which will now be defined by appended claims.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

I claim:

1. A thermoelectric cooling apparatus comprising:

a source; and a thermoelectric cooler coupled to said source, said thermoelectric cooler having an operating state;

wherein said source is configured to provide a signal to said thermoelectric cooler to periodically alter at pre-defined time intervals said operating state of said thermoelectric cooler in response to said signal; and wherein said pre-defined time intervals are selected such that a mean time between failure for the thermoelectric cooling apparatus is substantially maximized.

2. The apparatus, as recited in claim 1, wherein said source is configured to provide said signal to said thermoelectric cooler top alter said operating state from an active state to a passive state.

3. The apparatus, as recited in claim 2, wherein said signal, in said active state, has a current defined by the following formula:

$$I_a = \frac{\alpha \Delta T}{R\left(\sqrt{1+Z\overline{T}}-1\right)}$$

$I_a$ = Active current signal state $R$ = Combined resistance of thermoelectric arrays $\Delta T$ = Temperature differential across the thermoelectric cooling apparatus $Z$ = Thermoelectric figure of merit $\alpha$ = Seebeck coefficient $\overline{T}$ = Average temperature across the thermoelements

4. The apparatus, as recited in claim 2, wherein said signal, in said passive state, has a current defined by the following formula:

$$I_p = \left(\frac{\alpha T_c}{R}\right)\left(1-\sqrt{1-\frac{\Delta T}{\Delta T_{max}}}\right)$$

$I_P$=Passive current signal state

R=Combined resistance of thermoelectric arrays

ΔT=Change in temperature

α=Seebeck coefficient $T_c$=Temperature of the cold end of the thermoelectric cooling apparatus $\Delta T_{max}$=maximum temperature differential across the thermoelectric cooling apparatus.

5. The apparatus, as recited in claim 1, wherein said thermoelectric cooler includes at least one thermoelectric element.

6. The apparatus, as recited in claim 1, wherein said thermoelectric cooler includes at least one thermoelectric array.

7. The apparatus, as recited in claim 1, wherein said thermoelectric cooler is a multi-stage thermoelectric cooler.

8. The apparatus, as recited in claim 1, wherein said thermoelectric cooler includes at least one Peltier device.

9. The apparatus, as recited in claim 1, further comprising:

a second thermoelectric cooler coupled to said source, said second thermoelectric cooler having a second state;

wherein said source is configured to provide a second signal to said second thermoelectric cooler to periodically alter said second state of said second thermoelectric cooler in response to said second signal.

10. The apparatus, as recited in claim 9, wherein said second signal is phase shifted relative to said first signal such that, for a predetermined time, said first thermoelectric cooler is in an active state while said second thermoelectric cooler is in a passive state.

11. The apparatus, as recited in claim 1, further comprising a monitoring circuit associated with said thermoelectric cooler for monitoring operating characteristics of said thermoelectric cooler.

12. The apparatus, as recited in claim 1, wherein said thermoelectric cooling apparatus is associated with a food refrigeration system.

13. The apparatus, as recited in claim 1, wherein said thermoelectric cooling apparatus is associated with a vehicle occupant cooling system.

14. The apparatus, as recited in claim 1, wherein said thermoelectric cooling apparatus is associated with least one integrated circuit device.

15. The apparatus, as recited in claim 1, further comprises at least one microelectromechanical (MEMS) device.

16. A thermoelectric cooling apparatus comprising:

a source;

a first thermoelectric cooler coupled to said source, said first thermoelectric cooler having a first state; and a second thermoelectric cooler coupled to said source, said second thermoelectric cooler having a second state;

wherein said source is configured to provide a first signal to said first thermoelectric cooler to periodically alter at pre-defined time intervals said first state of said first thermoelectric cooler in response to said first signal;

wherein said source is configured to provide a second signal to said second thermoelectric cooler to periodically alter at pre-defined time intervals said second state of said second thermoelectric cooler in response to said second signal; and wherein said pre-defined time intervals are selected such that a mean time between failure for the thermoelectric cooling apparatus is substantially maximized.

17. The apparatus, as recited in claim 16, wherein said second signal is phase shifted relative to said first signal such that, for a predetermined time, said first thermoelectric cooler is in an active state while said second thermoelectric cooler is in a passive state.

18. The apparatus, as recited in claim 16, further comprising a monitoring circuit associated with said first thermoelectric cooler and said second thermoelectric cooler for monitoring operating characteristics of said first thermoelectric cooler and said second thermoelectric cooler.

19. The apparatus, as recited in claim 16, wherein said source is configured to provide said first signal to said first thermoelectric cooler to alter said first state from an active state to a passive state and said second signal to said second thermoelectric cooler to alter said second state from an active state to a passive state.

20. The apparatus, as recited in claim 19, wherein said first and second signals, in said active state, have a current defined by the following formula:

$$I_a = \frac{\alpha \Delta T}{R\left(\sqrt{1+Z\overline{T}}-1\right)}$$

$I_a$=Active current signal state

R=Combined resistance of thermoelectric arrays

ΔT=Temperature differential across the thermoelectric cooling apparatus

Z=Thermoelectric figure of merit

α=Seebeck coefficient $\overline{T}$=Average temperature across the thermoelements.

21. The apparatus, as recited in claim 19, wherein said first and second signals, in said passive state, have a current defined by the following formula:

$$I_p = \left(\frac{\alpha T_c}{R}\right)\left(1-\sqrt{1-\frac{\Delta T}{\Delta T_{max}}}\right)$$

$I_p$=Passive current signal state

R=Combined resistance of thermoelectric arrays

ΔT=Change in temperature

α=Seebeck coefficient $T_c$=Temperature of the cold end of the thermoelectric cooling apparatus $\Delta T_{max}$=maximum temperature differential across the thermoelectric cooling apparatus $\Delta T_{max}$=Maximum change in temperature.

22. The apparatus, as recited in claim 16, wherein said first and second thermoelectric coolers include at least one thermoelectric array.

23. The apparatus, as recited in claim 16, wherein said first and second thermoelectric coolers include at least one thermoelectric element.

24. The apparatus, as recited in claim 16, wherein said first and second thermoelectric coolers are multi-staged thermoelectric coolers.

25. The apparatus, as recited in claim 16, wherein said first and second thermoelectric coolers include at least one Peltier device.

26. The apparatus, as recited in claim 16, wherein said thermoelectric cooling apparatus is associated with a food refrigeration system.

27. The apparatus, as recited in claim 16, wherein said thermoelectric cooling apparatus is associated with a vehicle occupant cooling system.

28. The apparatus, as recited in claim 16, wherein said thermoelectric cooling apparatus is associated with at least one integrated circuit device.

29. The apparatus, as recited in claim 16, further comprises at least one microelectromechanical (MEMS) device.

30. A method of operating a thermoelectric cooling apparatus having a source, a thermoelectric cooler coupled to the source, the thermoelectric cooler having an operating state, comprising the steps of:

providing a signal to the thermoelectric cooler; and periodically altering at pre-defined time intervals the operating state of the thermoelectric cooler in response to the signal;

wherein said pre-defined time intervals are selected such that a mean time between failure for the thermoelectric cooling apparatus is substantially maximized.

31. The method, as recited in claim 30, wherein said source is configured to provide said signal to said thermoelectric cooler to alter the operating state from an active state to a passive state.

32. The method, as recited in claim 31, wherein the signal, in the active state, has a current defined by the following formula:

$$I_a = \frac{\alpha \Delta T}{R\left(\sqrt{1+Z\overline{T}}-1\right)}$$

$I_a$=Active current signal state

R=Combined resistance of thermoelectric arrays

ΔT=Temperature differential across the thermoelectric cooling apparatus

Z=Thermoelectric figure of merit

α=Seebeck coefficient $\overline{T}$=Average temperature across the thermoelements.

33. The method, as recited in claim 31, wherein said signal, in said passive state, has a current defined by the following formula:

$$I_p = \left(\frac{\alpha T_c}{R}\right)\left(1-\sqrt{1-\frac{\Delta T}{\Delta T_{max}}}\right)$$

$I_p$=Passive current signal state

R=Combined resistance of thermoelectric arrays

ΔT=Change in temperature

α=Seebeck coefficient $T_c$=Temperature of the cold end of the thermoelectric cooling apparatus $\Delta T_{max}$=maximum temperature differential across the thermoelectric cooling apparatus.

34. The method, as recited in claim 31, further comprising the steps of:

including a second thermometric cooler coupled to the source, wherein the second thermoelectric cooler has a second state; and providing a second signal to periodically alter the second state of the second thermoelectric cooler.

35. The method, as recited in claim 34, wherein said second signal is phase shifted relative to said signal such that, for a predetermined time, said thermoelectric cooler is in an active state while said second thermoelectric cooler is in a passive state.

36. The method, as recited in claim 31, further comprising the step of monitoring the operating characteristics of said thermoelectric cooler.

37. A method of operating a thermoelectric cooling apparatus having a source, a first thermoelectric cooler coupled to the source, wherein the thermoelectric cooler has a first state, a second thermoelectric cooler coupled to the source, wherein the second thermoelectric cooler has a second state, comprising the steps of:

providing a first signal to the first thermoelectric cooler;

periodically altering at pre-defined time intervals the first state of the first thermoelectric cooler in response to the first signal;

providing a second signal to the second thermoelectric cooler;

periodically altering at pre-defined time intervals the second state of the second thermoelectric cooler in response to the second signal;

wherein said pre-defined time intervals are selected such that a mean time between failure for the thermoelectric cooling apparatus is substantially maximized.

38. The method, as recited in claim 37, wherein said source is configured to provide said first signal to said first thermoelectric cooler to alter said first state from an active state to a passive state and to provide said second signal to said second thermoelectric cooler to alter said second state from an active state to a passive state.

39. The method, as recited in claim 38, wherein the first and second signals, in the active state, are defined by the following formula:

$$I_a = \frac{\alpha \Delta T}{R\left(\sqrt{1+Z\overline{T}}-1\right)}$$

$I_a$=Active current signal state

R=Combined resistance of thermoelectric arrays

ΔT=Temperature differential across the thermoelectric cooling apparatus

Z=Thermoelectric figure of merit

α=Seebeck coefficient $\overline{T}$=Average temperature across the thermoelements.

40. The method, as recited in claim 38, wherein said first and second signals, in the passive state, have a current defined by the following formula:

$$I_p = \left(\frac{\alpha T_c}{R}\right)\left(1-\sqrt{1-\frac{\Delta T}{\Delta T_{max}}}\right)$$

$I_p$=Passive current signal state

R=Combined resistance of thermoelectric arrays

ΔT=Change in temperature

α=Seebeck coefficient $T_c$=Temperature of the cold end of the thermoelectric cooling apparatus $\Delta T_{max}$=maximum temperature differential across the thermoelectric cooling apparatus.

41. The method, as recited in claim 37, wherein said second signal is phase shifted relative to said signal such that, for a predetermined time, said thermoelectric cooler is in an active state with said second thermoelectric cooler is in a passive state.

42. The method, as recited in claim 37, further comprising the step of monitoring the operating characteristics of said thermoelectric cooler.

43. A signal, propagating in a propagation medium for operating a thermoelectric cooler, for periodically altering at pre-defined time intervals the thermoelectric cooler from a first state to a second state wherein said pre-defined time intervals are selected such that a mean time between failure for the thermoelectric cooling apparatus is substantially maximized.

44. The signal, as recited in claim 43, wherein said first state is configured to be an active state and said second state is configured to be a passive state.

45. The signal, as recited in claim 43, wherein said signal, in said active state, has a current defined by the following formula:

$$I_a = \frac{\alpha \Delta T}{R\left(\sqrt{1 + Z\overline{T}} - 1\right)}$$

$I_a$=Active current signal state

R=Combined resistance of thermoelectric arrays

ΔT=Temperature differential across the thermoelectric cooling apparatus

Z=Thermoelectric figure of merit

α=Seebeck coefficient $\overline{T}$=Average temperature across the thermoelements.

46. The signal, as recited in claim 44, wherein said signal, in said passive state, has a current defined by the following formula:

$$I_p = \left(\frac{\alpha T_c}{R}\right)\left(1 - \sqrt{1 - \frac{\Delta T}{\Delta T_{max}}}\right)$$

$I_p$=Passive current signal state

R=Combined resistance of thermoelectric arrays

ΔT=Change in temperature

α=Seebeck coefficient $T_c$=Temperature of the cold end of the thermoelectric cooling apparatus $\Delta T_{max}$=maximum temperature differential across the thermoelectric cooling apparatus.

* * * * *

UNITED STATES PATENT AND TRADEMARK OFFICE

CERTIFICATE OF CORRECTION

PATENT NO. : 6,266,962 B1
DATED : July 31, 2001
INVENTOR(S) : Ghoshal

It is certified that error appears in the above-identified patent and that said Letters Patent is hereby corrected as shown below:

Column 10,
Line 31, please delete "top" and insert -- to --;

Signed and Sealed this

Thirtieth Day of July, 2002

*Attest:*

*Attesting Officer*

JAMES E. ROGAN
*Director of the United States Patent and Trademark Office*